US008571446B2

(12) United States Patent
Iwata

(10) Patent No.: US 8,571,446 B2
(45) Date of Patent: Oct. 29, 2013

(54) DEVELOPING DEVICE AND IMAGE FORMING APPARATUS INCLUDING THE SAME

(75) Inventor: Naoya Iwata, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 289 days.

(21) Appl. No.: 12/977,380

(22) Filed: Dec. 23, 2010

(65) Prior Publication Data

US 2011/0158700 A1 Jun. 30, 2011

(30) Foreign Application Priority Data

Dec. 25, 2009 (JP) ..... 2009-295945
Jul. 19, 2010 (KR) ..... 10-2010-0069606

(51) Int. Cl.
*G03G 15/08* (2006.01)

(52) U.S. Cl.
USPC ..... 399/256; 399/254

(58) Field of Classification Search
USPC ..... 399/254, 256
See application file for complete search history.

(56) References Cited

U.S. PATENT DOCUMENTS 5,758,238 A * 5/1998 Mordenga et al. ..... 399/256
6,415,125 B1 * 7/2002 Yamamoto et al. ..... 399/254
6,421,516 B1 * 7/2002 Kinoshita et al. ..... 399/254
6,834,175 B2 * 12/2004 Murayama et al. ..... 399/256
7,035,573 B2 * 4/2006 Yamaguchi et al. ..... 399/256
7,039,344 B2 * 5/2006 Nishiyama ..... 399/254
7,391,995 B2 * 6/2008 Fujioka ..... 399/254 X
7,391,998 B2 * 6/2008 Aoki et al. ..... 399/254

FOREIGN PATENT DOCUMENTS

JP 2005-352042 12/2005
JP 2006-023355 1/2006
JP 2006-178381 7/2006
JP 2009-092685 4/2009

* cited by examiner

*Primary Examiner* — Sandra Brase
(74) *Attorney, Agent, or Firm* — Stanzione & Kim, LLP

(57) ABSTRACT

A developing device and an image forming apparatus including the same includes an agitating and conveying unit that receives a developer, and at least one agitating and conveying member to mix and agitate the developer and convey the developer in a developer conveying direction. A developing roller faces a photosensitive drum on which an electrostatic latent image is formed, and attaches the developer to an outer surface of the developing roller. The agitating and conveying member includes a support shaft extending in the developer conveying direction. A plurality of agitation wings disposed on an outer surface of the support shaft to mix and agitate the developer. At least one paddle protrudes from the support shaft in a radial direction and extends along the shaft between adjacent agitation wings. The at least one paddle has a height increasing from an upstream side to a downstream side of the developer conveying direction.

18 Claims, 7 Drawing Sheets

DEVELOPING DEVICE AND IMAGE FORMING APPARATUS INCLUDING THE SAME

CROSS-REFERENCE TO RELATED APPLICATIONS

This application claims priority under 35 U.S.C. §119(a) from Japanese Patent Application No. 2009-295945, filed on Dec. 25, 2009, in the Japanese Patent Office, and also Korean Patent Application No. 10-2010-0069606, filed on Jul. 19, 2010, in the Korean Intellectual Property Office, the disclosures of which are incorporated herein in their entirety by reference.

BACKGROUND

1. Field of the Invention

The present general inventive concept relates to a developing device and an image forming apparatus using a two-component developing method.

2. Description of the Related Art

In general, an auger, which is a shaft with a spiral wing, is used as a developer agitating and conveying member. However, as developing units have become smaller in recent years, the developer mixing and agitating performance has decreased. In order to solve this problem, the developer mixing and agitating performance is maintained in relation to the auger in three ways.

First, the developer mixing and agitating performance is maintained by lengthening a mixing and agitation path. In detail, the developer mixing and agitating performance is maintained by increasing a mixing and agitation space or lengthening a shaft of an auger in an axial direction.

Second, the developer mixing and agitating performance is maintained by installing a previous agitation chamber for previously agitating a developer, agitating the developer in the previous agitation chamber, and supplying the developer to a mixing and agitation path.

Third, the developer mixing and agitating performance is improved by adding a wing member, such as a paddle, to a shaft of an auger.

Most recent printers or copy machines are inexpensive and small. Many general developing systems include two augers for mixing and agitating a developer.

However, if the number of augers is increased in order to lengthen the mixing and agitation path, the number of parts, such as a housing for storing the augers, a bearing for the augers, and a sealing member, is increased, thereby increasing manufacturing costs. Also, as the number of parts is increased, the size of a developing unit is increased. When an auger path is increased by lengthening shafts of the augers in the axial direction, the size of an M/C is increased in order to cover the auger path in the axial direction, and the amount of developer is increased due to the increase in the size of the developing unit.

Also, even when the developer is supplied to the mixing and agitation path after the developer is agitated in the previous agitation chamber, a space for the previous agitation chamber is needed and parts, such as an agitating member, is additionally needed. Also, since excessive stress is applied to the developer in the previous agitation chamber, the developer deteriorates.

Also, a protruding agitating member may protrude in a spiral shape around a shaft of an auger. However, although the developer agitating performance at an early stage is good, if the protruding agitating member is used for a long time, fiber-like foreign materials may be wound around the protruding agitating member, thereby degrading the developer agitating performance. Also, when the protruding agitating member, which is easily deformed, is used, the protruding agitating member may be deformed, thereby easily coagulating the developer.

When the developer agitating performance is improved by missing some spiral blades of an auger, although costs are reduced and the developer agitating performance is improved, the developer conveying performance may be drastically reduced. Also, in this case, since an excessive amount of developer remains, a large space for the remaining developer is needed, thereby increasing the size of a device.

SUMMARY

The present general inventive concept provides a developing device that is inexpensive and small by including an agitating and conveying member having both an agitation function and a conveying function, and an image forming apparatus including the developing device.

Additional features and utilities of the present general inventive concept will be set forth in part in the description which follows and, in part, will be obvious from the description, or may be learned by practice of the present general inventive concept.

According to an feature of the present general inventive concept, there is provided a developing device including: an agitating and conveying unit which receives a developer formed of carrier and toner, and includes at least one agitating and conveying member for mixing and agitating the developer and conveying the developer in a developer conveying direction; and a developing roller which is installed facing a photosensitive drum on which an electrostatic latent image is formed, and attaches the developer mixed and agitated by the agitating and conveying unit to an outer circumferential surface of the developing roller and supplies the developer to the photosensitive drum, wherein the agitating and conveying member includes: a support shaft which extends in the developer conveying direction and is rotatably installed; a plurality of agitation wings which are installed on an outer circumferential surface of the support shaft, and mix and agitate the developer and convey the developer; and at least one paddle which protrudes in a radial direction from the support shaft in a direction of the support shaft in a pitch that is a distance between adjacent agitation wings of the plurality of agitation wings in the direction of the support shaft and has a height increasing from an upstream side to a downstream side of the developer conveying direction.

According to another feature of the present general inventive concept, there is provided an image forming apparatus including: a photosensitive drum on an outer circumferential surface of which an electrostatic latent image is formed; and a developing device which develops the electrostatic latent image formed on the photosensitive drum, wherein the developing device includes: an agitating and conveying unit which receives a developer formed of carrier and toner, and comprises at least one agitating and conveying member for mixing and agitating the developer and conveying the developer in a developer conveying direction; and a developing roller which is installed facing the photosensitive drum on which the electrostatic latent image is formed, and attaches the developer agitated and conveyed by the agitating and conveying unit to an outer circumferential surface of the developing roller and supplies the developer to the photosensitive drum, wherein the agitating and conveying member includes: a support shaft which extends in the developer conveying direction and is rotatably installed; a plurality of agitation wings which are formed on an outer circumferential surface of the support shaft, and mix and agitate the developer and convey the developer; and at least one paddle which protrudes in a radial direction from the support shaft in a direction of the support shaft in a pitch that is a distance between adjacent agitation wings of the plurality of agitation wings in the direction of the support shaft and has a height increasing from an upstream side to a downstream side of the developer conveying direction.

In still another feature, an agitating and conveying unit to convey developer stored in a developing unit in a conveying direction, comprising a first support shaft extending along the conveying direction; a second support shaft disposed adjacent the first support shaft and extending parallel to the first support shaft in the conveying direction; a partition disposed between the first and second support shafts to define first and second developer passages between the developing unit and the partition; a plurality of first wings disposed on the first shaft each being inclined in a first direction; and a plurality of second wings disposed on the second shaft each being inclined in a second direction opposite the first direction of the first wings.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
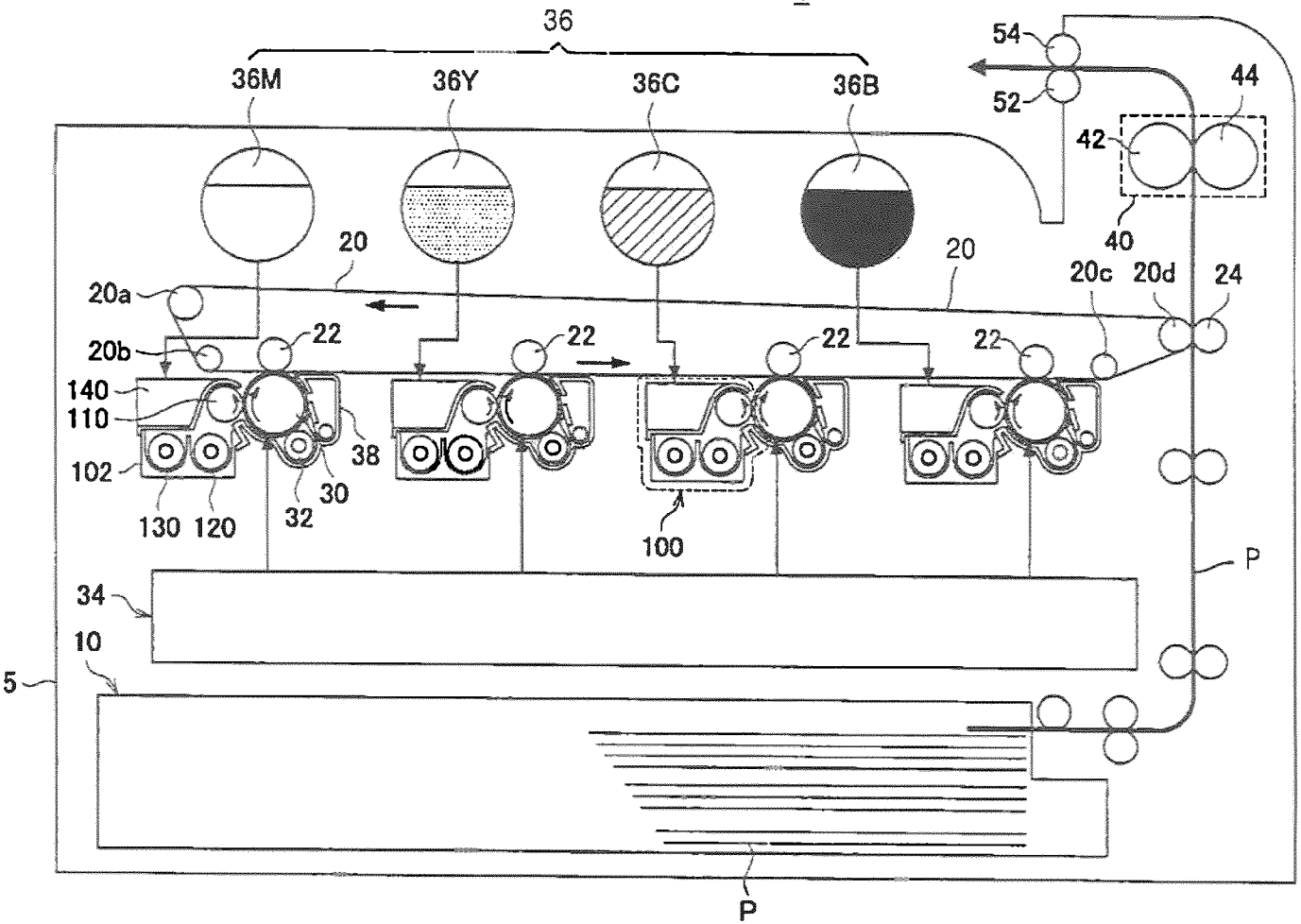
FIG. 1 is a cross-sectional view of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a cross-sectional view illustrating an image forming apparatus 1 according to an embodiment of the present general inventive concept.

Referring to FIG. 1, the image forming apparatus 1 includes a recording medium conveying unit 10, a transfer unit including a transfer belt 20 as an intermediate transfer body, a photosensitive drum 30 to hold an electrostatic latent image, a developing unit 100 to develop the electrostatic latent image formed on the photosensitive drum 30, and a fixing unit 40. The developing unit 100 may be applied to a tandem-type image forming apparatus.

The recording medium conveying unit 10 receives a recording medium (P) on which an image is to be finally formed, and conveys the recording medium to a recording medium conveying path. The recording medium may be, for example, paper P, and recording media are stacked in a cassette. The recording medium conveying unit 10 enables the paper P to reach a secondary transfer region when a toner image transferred to the paper P reaches the secondary transfer region.

The transfer unit transfers the toner image formed by the developing unit 100 to the secondary transfer region where the toner image is secondarily transferred to the recording medium. The transfer unit includes the transfer belt 20, a plurality of support rollers 20*a*, 20*b*, 20*c*, and 20*d* to support the transfer belt 20, a primary transfer roller 22 contacting the photosensitive drum 30 through the transfer belt 20 and designed to support the transfer belt 20 between the primary transfer roller 22 and the photosensitive drum 30, and a secondary transfer roller 24 contacting the support roller 20*d* and designed to support the transfer belt 20 between the secondary transfer roller 24 and the support roller 20*d*.

The transfer belt 20 is an endless belt circulated by the plurality of support rollers 20*a*, 20*b*, 20*c*, and 20*d*. The primary transfer roller 22 is installed at an inner peripheral side of the transfer belt 20 to press the transfer belt 20 toward the photosensitive drum 30. The secondary transfer roller 24 is installed at an outer peripheral side of the transfer belt 20 to press against the support roller 20*d* through the recording medium (P). Although not shown in FIG. 1, the transfer unit may further include a belt cleaning device to remove toner attached to the transfer belt 20.

The photosensitive drum 30 of which an electrostatic latent image is formed thereon is disposed on an outer circumferential surface, may be formed of, for example, an organic photoconductor (OPC). The image forming apparatus 1 of FIG. 1, which is an apparatus to form a color image, may include four photosensitive drums 30 corresponding to different colors, for example, magenta, yellow, cyan, and black, installed in a rotation direction of the transfer belt 20. A charge roller 32, an exposure unit 34, the developing unit 100, and a cleaning unit 38 are installed around each of the four photosensitive drums 30 as shown in FIG. 1.

The charge roller 32 uniformly charges a surface of the photosensitive drum 30 to a predetermined potential via, for example, rotational friction. The exposure unit 34 exposes the surface of the photosensitive drum 30 charged by the charge roller 32 according to an image to be formed. Accordingly, a potential of a part of the surface of the photosensitive drum 30 exposed by the exposure unit 34 is changed to form an electrostatic latent image. The developing unit 100 develops the electrostatic latent image formed on the photosensitive drum 30 by using toner supplied from one or more toner tanks 36 to form a toner image. A configuration of the developing unit 100 will be explained later in detail.

The cleaning unit 38 collects residual toner remaining on the photosensitive drum 30 after the toner image formed on the photosensitive drum 30 is primarily transferred to the transfer belt 20. The cleaning unit 38 may be configured so that, for example, a cleaning blade is installed and is brought into contact with the outer circumferential surface of the photosensitive drum 30 to remove the residual toner remaining on the photosensitive drum 30. A discharger lamp (not shown) to reset a potential of the photosensitive drum 30 may be disposed between the cleaning unit 38 and the charge roller 32 in a rotation direction of the photosensitive drum 30 around the photosensitive drum 30.

The fixing unit 40 attaches a toner image transferred from the transfer belt 20 to the recording medium, and fixes the toner image to a recording medium (P) passing between the heat roller 42 and the pressure roller 44. The fixing unit 40 includes a heating roller 42 and a pressure roller 44. More specifically, the heating roller 42 is a cylindrical member that may rotate in a direction of a rotation axis and a heat source, such as a halogen lamp (not shown), is provided in the heating roller 42. The pressure roller 44 is a cylindrical member that may rotate in the direction of the rotation axis, and is installed to press the heating roller 42. A heat-resistant elastic layer formed of silicon rubber or the like may be installed on outer circumferential surfaces of the heating roller 42 and the pressure roller 44. The toner image is melted and fixed to the recording medium by passing the recording medium through a fixing nip portion that is a contact area between the heating roller 42 and the pressure roller 44.

The image forming apparatus 1 further includes exiting rollers 52 and 54 to exit the recording medium to which the toner image is fixed by the fixing unit 40 outwardly from the image forming apparatus 1.

An operation of the image forming apparatus 1 configured as described above will now be explained.

When the image forming apparatus 1 operates, an image signal of an image to be recorded is transmitted to a control unit (not shown). Next, the control unit controls the charge roller 32 to uniformly charge the surface of the photosensitive drum 30 to a predetermined potential, and the exposure unit 34 to emit laser light to the surface of the photosensitive drum 30 to form an electrostatic latent image.

Meanwhile, the developing unit 100 charges developer, which includes toner and carrier, by mixing and agitating the toner and the carrier and attaches a developer to a developing roller 110 (see FIG. 1). Next, when the developer is conveyed to an area facing the photosensitive drum 30 due to a rotation of the developing roller 110, the toner of the developer attached to the developing roller 110 is moved to the electrostatic latent image formed on the outer circumferential surface of the photosensitive drum 30 to develop the electrostatic latent image and form a toner image. The toner image is primarily transferred from the photosensitive drum 30 to the transfer belt 20 in an area where the photosensitive drum 30 and the transfer belt 20 face each other. A plurality of the toner images formed on the four photosensitive drums 30 are sequentially stacked on the transfer belt 20 to form one stacked toner image. The stacked toner image is secondarily transferred to the recording medium conveyed from the recording medium conveying unit 10 in an area where the support roller 20*d* and the secondary transfer roller 24 contact each other.

The recording medium to which the stacked toner image is secondarily transferred is conveyed to the fixing unit 40. The stacked toner image is melted and fixed to the recording medium when the recording medium passes between the heating roller 42 and the pressure roller 44 by applying heat and pressure, respectively. Next, the recording medium is exited to the outside of the image forming apparatus 1 by the exiting rollers 52 and 54. Meanwhile, if the transfer belt 20 includes the belt cleaning device (not shown), the belt cleaning device may remove residual toner remaining on the transfer belt 20 after the stacked toner image is secondarily transferred to the recording medium (P).

Although the image forming apparatus 1 illustrates a tandem-type image forming apparatus, uses the developing device 100 in FIG. 1, the present embodiment is not limited thereto and the developing device 100 may be applied to various other types of image forming apparatuses.

Next, a configuration and an operation of the developing unit 100 will now be explained with reference to FIGS. 2 and 3.

Figure 2:
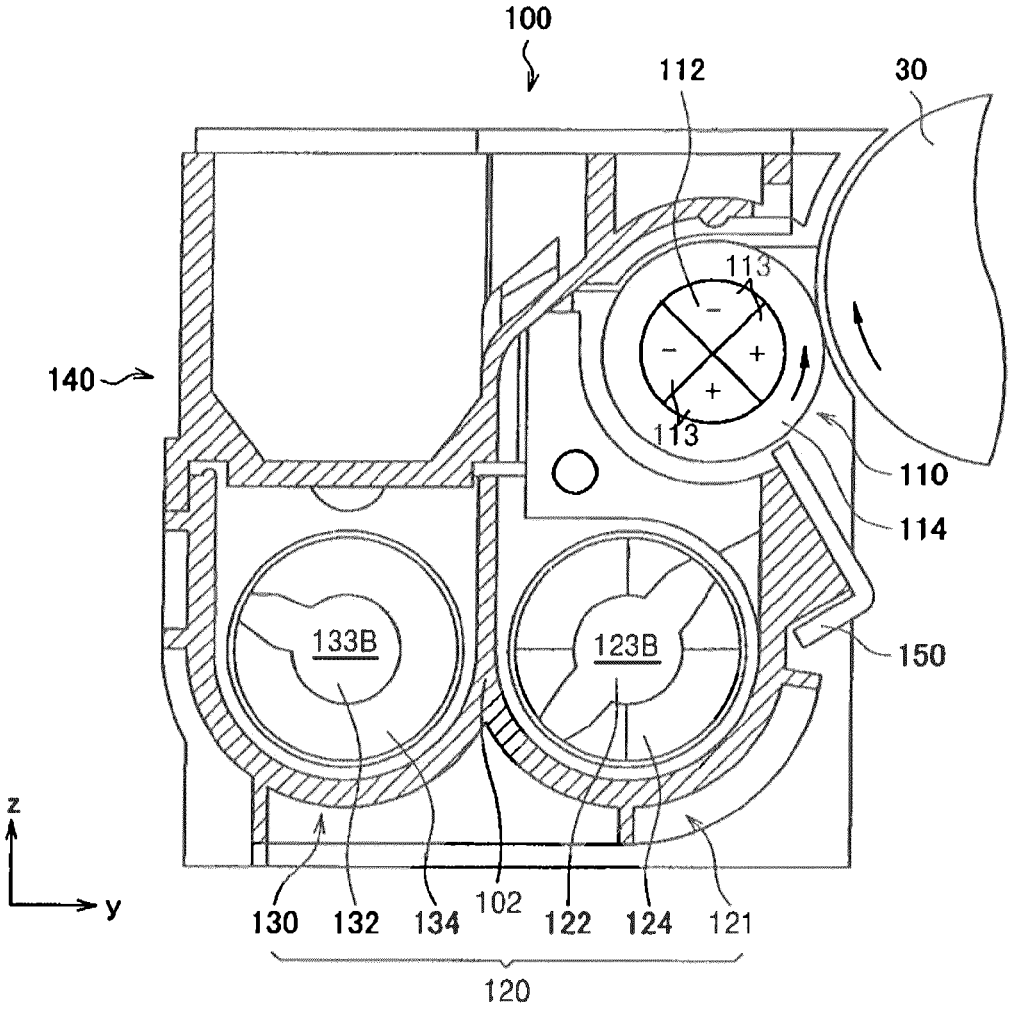
FIG. 2 is a cross-sectional view of a developing unit of the image forming apparatus of FIG. 1.

FIG. 2 is a cross-sectional view illustrating the developing unit 100 of the image forming apparatus 1 of FIG. 1. FIG. 3 is a cross-sectional view illustrating the flow of a developer in the developing unit 100 of the image forming apparatus 1 of FIG. 1.

Figure 3:
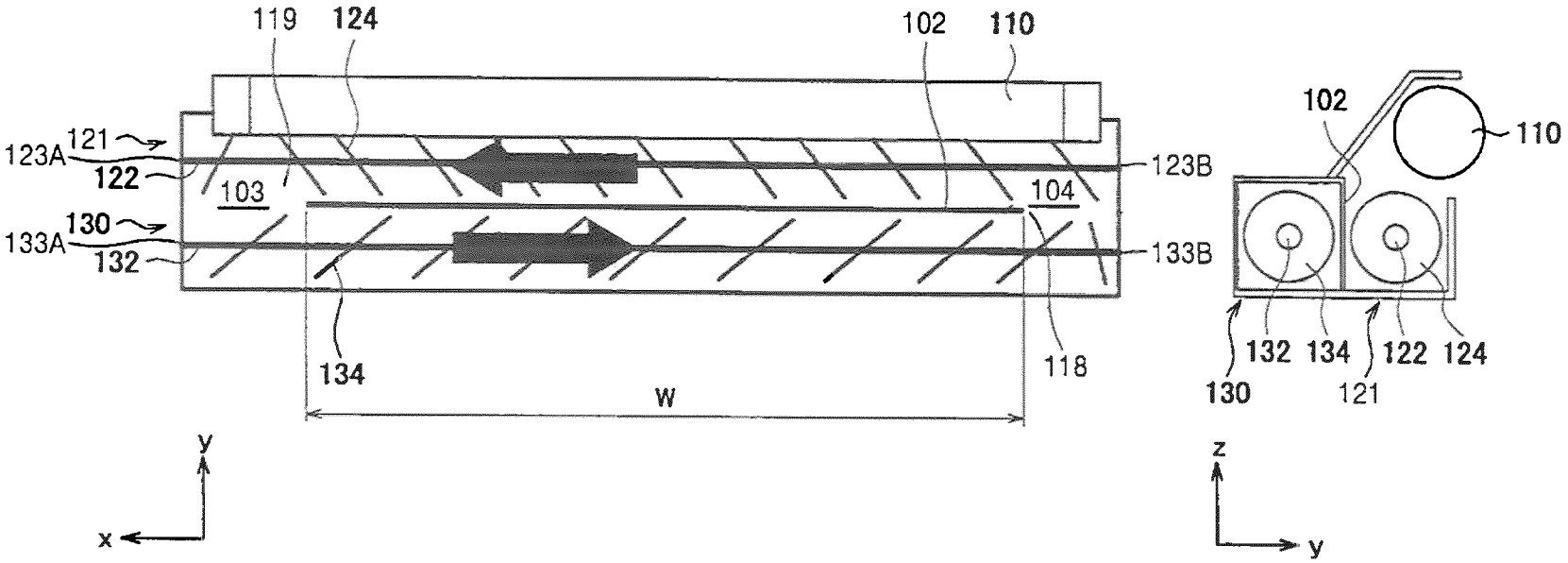
FIG. 3 is a cross-sectional view for explaining the flow of a developer in the developing unit of the image forming apparatus of FIG. 1.

Referring to FIGS. 2 and 3, the developing unit 100 includes the developing roller 110 and an agitating and conveying unit 120.

The developing roller 110 is a developer holding body to supply toner to an electrostatic latent image formed on the outer circumferential surface of the photosensitive drum 30. The developing roller 110 includes, but is not limited to, a developing sleeve 114, and a magnet 112 disposed inside the developing sleeve 114. The developing sleeve 114 may be formed as, for example, cylindrical member, and may be formed of a non-magnetic metal. Only the developing sleeve 114 of the developing roller 110 rotates. Accordingly, the magnet 112 disposed inside the developing sleeve 114 is fixed to a housing 5 (see FIG. 1). The developing roller 110 may include a developing bias-applying unit (not shown) to apply a developing bias.

The magnet 112 includes a plurality of magnetic poles 113. For example, positive (+) magnetic poles may be disposed at an area where the photosensitive drum 30 and the magnet 112 face each other, while negative (−) magnetic poles may be disposed at areas that do not face the photosensitive drum 30. Accordingly, an area at which the electrostatic latent image formed on the photosensitive drum 30 is developed at a position at which at least one positive magnetic pole 113 faces the agitating and conveying unit 120. This is because the developer is conveyed due to a magnetic force on the developing sleeve 114. Also, since a magnetic brush contacts or approaches the electrostatic latent image formed on the photosensitive drum 30, by lifting an end of the magnetic brush of the developer in the position at which the electrostatic latent image formed on the photosensitive drum 30 is developed, a gap between the magnetic poles or pole deposition may be formed in the position at which the electrostatic latent image formed on the photosensitive drum 30 is developed. Meanwhile, magnetic poles having the same polarity may be circumferentially disposed adjacent to each other in a position at which the developing roller 110 and the agitating and conveying unit 120 correspond to each other. A magnetic force in a tangent direction and a normal direction to a rotation direction of the developing sleeve 114 is reduced in the gap due to the magnetic poles having the same polarity. Accordingly, the developer is detached from the developing sleeve 114 in the position where the developing roller 110 and the agitating and conveying unit 120 face each other due to a rotation of the developing sleeve 114.

A layer restriction member 150 is installed at an upstream end of the rotation direction of the developing sleeve 114 based on the position at which the photosensitive drum 30 and the developing sleeve 114 of the developing roller 110 face each other. The layer restriction member 150 to enable the developer attached to an outer circumferential surface of the developing sleeve 114 to be uniformly distributed may be formed of, for example, a metal blade.

The agitating and conveying unit 120 is a unit to change the carrier and the toner, which constitute the developer, by agitating the magnetized carrier and the toner that is non-magnetic or weakly magnetized. The agitating and conveying unit 120 includes a first agitating and conveying member 121 and a second agitating and conveying member 130.

The first agitating and conveying member 121 is disposed facing the developing roller 110 in a direction substantially perpendicular to the developing roller 110, and supplies the mixed and agitated developer to the developing roller 110. The first agitating and conveying member 121 includes a first support shaft 122 and a plurality of first agitation wings 124. The first support shaft 122 is rotatably coupled to a bearing installed in an inner wall of the housing 5 and includes and upstream end 123A and a downstream end 123B (see FIG. 1). Each of the first agitation wings 124 are coupled to an outer circumferential surface of the first support shaft 122. Additionally, each of the first agitation wings 124 includes a spiral inclined surface that is disposed in a longitudinal direction of the first support shaft 122.

The second agitating and conveying member 130 sufficiently charges the developer by mixing and agitating the developer, and conveys the charged developer to the first agitating and conveying member 121. Similar to the first agitating and conveying member 121, the second agitating and conveying member 130 includes a second support shaft 132 and a plurality of second agitation wings 134. The second support shaft 132 is rotatably coupled to a bearing installed in the inner wall of the housing 5 and includes an upstream end 133A and a downstream end 133B (see FIG. 1). Each of the second agitation wings 134 are coupled to an outer circumferential surface of the second support shaft 132. In addition, each of the second agitating wings 134 includes a spiral inclined surface that is disposed in a longitudinal direction of the second support shaft 132.

The first agitating and conveying member 121 and the second agitating and conveying member 130 are disposed parallel to each other so that the first support shaft 122 and the second support shaft 132 are substantially parallel to each other, for example, in a substantially horizontal direction. A partition wall 102 is installed between the first agitating and conveying member 121 and the second agitating and conveying member 130 so that the first agitating and conveying member 121 and the second agitating and conveying member 130 are connected to each other on both ends thereof. Further, the partition 102 defines first and second developer passages 118, 119 to transfer the developer between the first agitating and conveying member 121 and the second agitating and conveying member 130. More specifically, the first developer passage 118 is located between the partition 102 and an inner surface of the image forming apparatus adjacent the downstream end of the first and second supports shafts 122,132. Similarly, the second developer passage 119 is located between the partition 102 and an inner surface of the image forming apparatus 1 adjacent the upstream end of the first and second support shafts 122, 132.

The developer is developed on a recording medium (P) by being agitated by the second agitating and conveying member 130, conveyed through the second developer passage 119, agitated and conveyed by the first agitating and conveying member 121, and moved to the outer circumferential surface of the developing roller 110. A toner density sensor (not shown) to detect toner density may be installed in the second agitating and conveying member 130. When toner density in a conveying path, in which the first agitating and conveying member 121 and the second agitating and conveying member 130 are installed and through which the toner is conveyed, is reduced, developer is supplied from the toner tank 36 to the conveying path via a developer supply unit 140.

Figure 4:
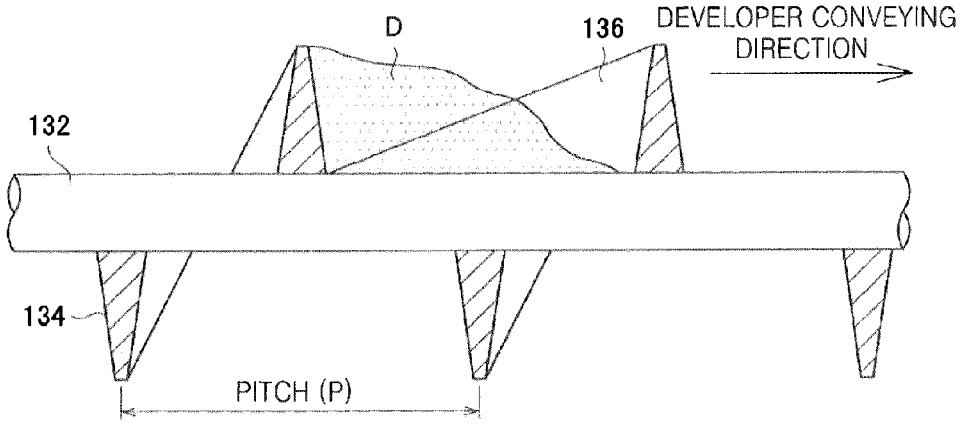
FIG. 4 is a partial cross-sectional view illustrating a paddle according to an embodiment of the present general inventive concept.

The agitating and conveying member may include one or more paddles, for example, the paddle 146 shown in FIG. 4, to improve the developer agitating performance without reducing developer conveying performance is installed in at least one of the first agitating and conveying member 121 an the second agitating and conveying member 130 of the developing unit 100.

A configuration of the paddle installed in the agitating and conveying unit 120 will now be explained in detail with reference to FIGS. 4 through 11.

Figure 5:
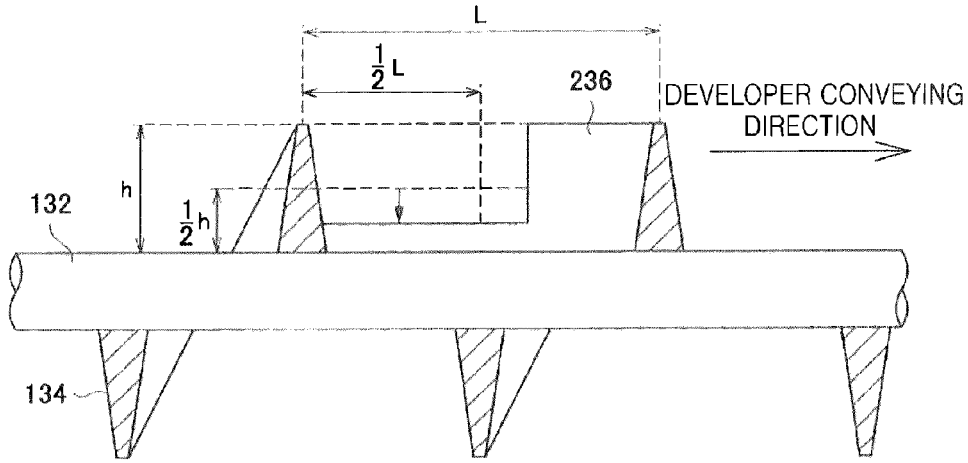
FIG. 5 is a partial cross-sectional view illustrating a paddle according to another embodiment of the present general inventive concept.
Figure 6:
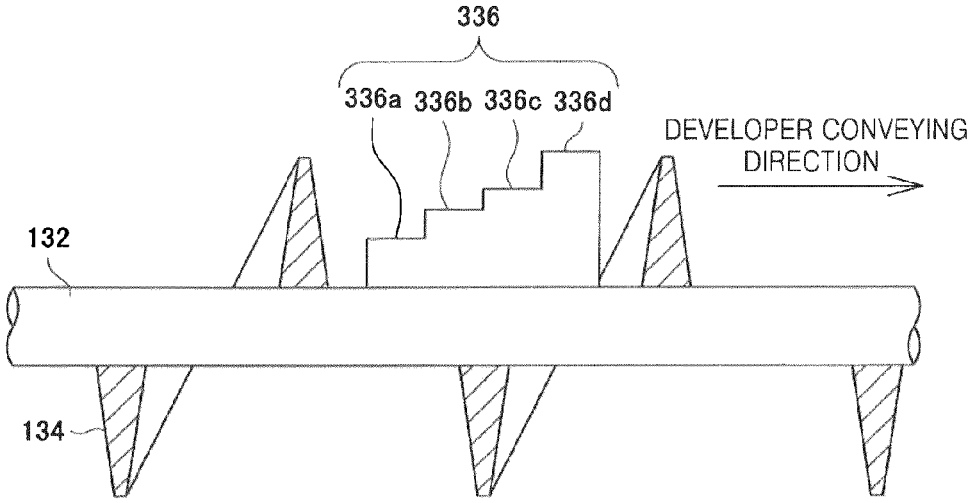
FIG. 6 is a partial cross-sectional view illustrating a paddle according to another embodiment of the present general inventive concept.
Figure 7:
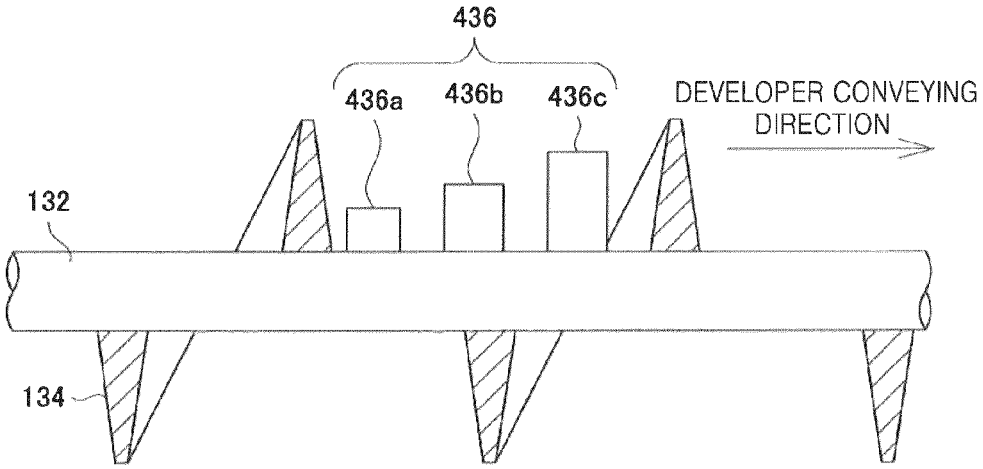
FIG. 7 is a partial cross-sectional view illustrating a paddle according to another embodiment of the present general inventive concept.
Figure 8:
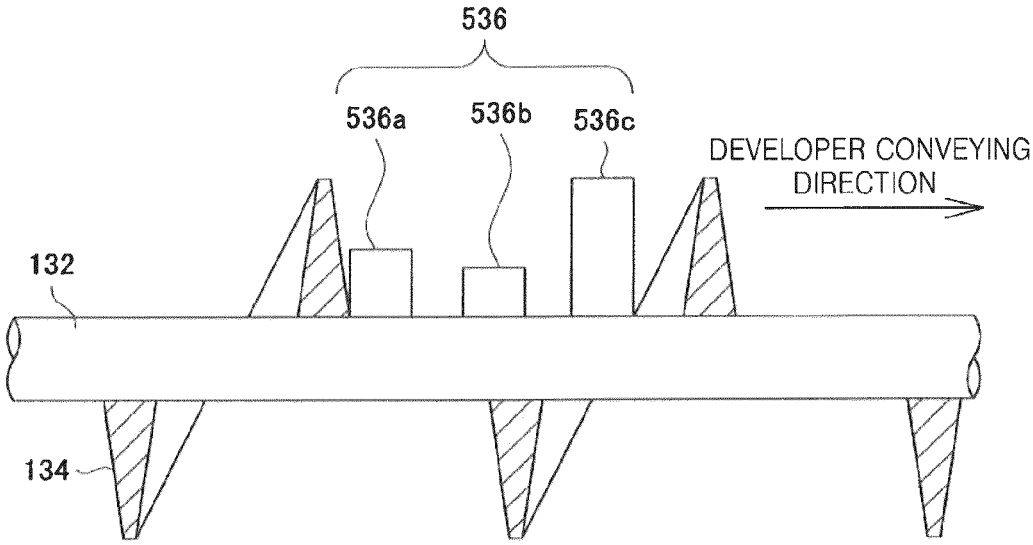
FIG. 8 is a partial cross-sectional view illustrating a paddle according to another embodiment of the present general inventive concept.
Figure 9:
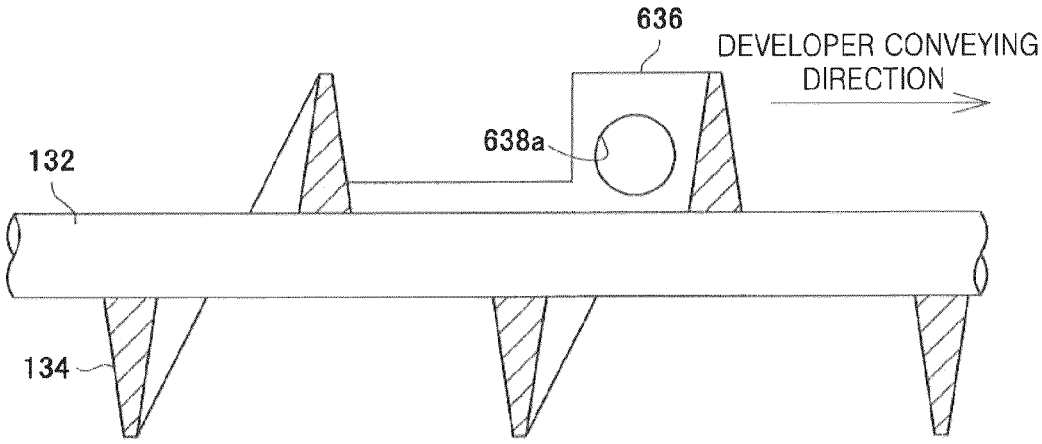
FIG. 9 is a partial cross-sectional view illustrating a paddle according to another embodiment of the present general inventive concept.
Figure 10:
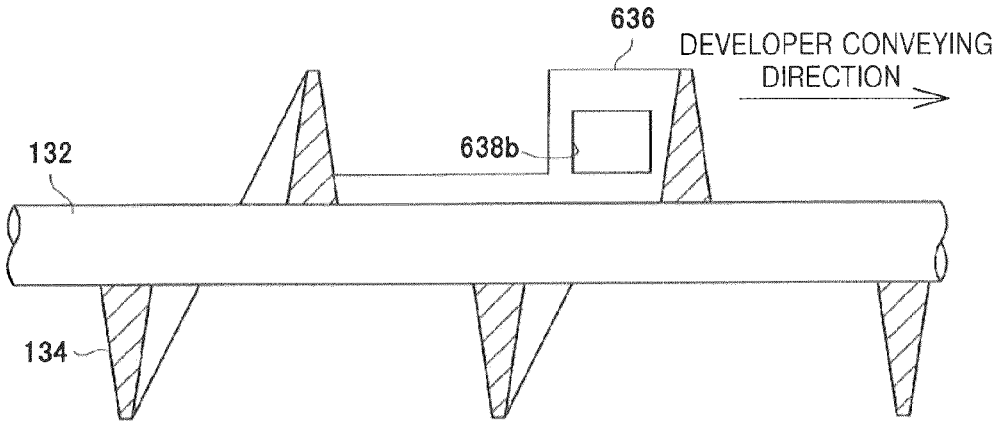
FIG. 10 is a partial cross-sectional view illustrating a paddle according to another embodiment of the present general inventive concept.
Figure 11:
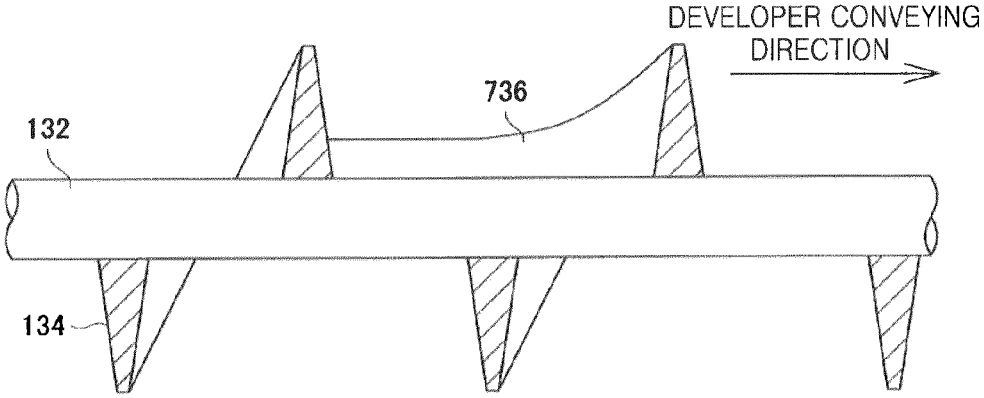
FIG. 11 is a partial cross-sectional view illustrating a paddle according to another embodiment of the present general inventive concept.

FIGS. 4 through 11 are partial cross-sectional views illustrating paddles installed in the agitating and conveying unit 120, according to embodiments of the present general inventive concept. FIG. 4 is a partial cross-sectional view illustrating a paddle 136 according to an embodiment of the present general inventive concept. FIG. 5 is a partial cross-sectional view illustrating a paddle 236 according to another embodiment of the present general inventive concept. FIG. 6 is a partial cross-sectional view illustrating a paddle 336 according to another embodiment of the present general inventive concept. FIG. 7 is a partial cross-sectional view illustrating a paddle 436 according to another embodiment of the present general inventive concept. FIG. 8 is a partial cross-sectional view illustrating a paddle 536 according to another embodiment of the present general inventive concept. FIG. 9 is a partial cross-sectional view illustrating a paddle 636 according to another embodiment of the present general inventive concept. FIG. 10 is a partial cross-sectional view illustrating a paddle 636, similar to the paddle 636 of FIG. 9, according to another embodiment of the present general inventive concept. FIG. 11 is a partial cross-sectional view illustrating a paddle 736 according to another embodiment of the present general inventive concept.

Although the paddles in FIGS. 4 through 11 are installed in the second agitating and conveying member 130, the paddles may be installed in the first agitating and conveying member 121.

Referring to FIG. 4, the second agitating and conveying member 130 includes the second support shaft 132 and the second agitation wings 134 as described above. The pitch may be a region defined by two adjacent agitation wings, and has a pitch length of a distance between the two adjacent agitation wings. The second agitating and conveying member 130 further includes a paddle 136 disposed in the pitch and extending along the pitch length in an axial direction of the second support shaft 132. Accordingly, the paddle 136 may increase a developer agitating force exerted on the developer transferred to an agitating and conveying path. Moreover, the paddle 136 of FIG. 4 is formed to have a height that increases in a radial direction of the second support shaft 132 toward a downstream side of the developer conveying direction to further increase the flow of developer.

The amount of developer transferred due to a rotation of the second agitating and conveying member 130 may be reduced toward the downstream side of the developer conveying direction in the pitch between the second agitation wings 134, as shown in FIG. 4. In order to increase the developer agitating performance without reducing the developer conveying performance, the paddle 136 may be installed in inverse proportion to a developer level (a height of a developer D transferred by the second agitating and conveying member 130 in the radial direction of the second support shaft 132). Accordingly, since the paddle 136 is installed in an area where the developer level is high, the developer D may be agitated from the inside (around the second support shaft 132).

Additionally, the paddle 136 of FIG. 4 may have a substantially triangular cross-sectional shape in the axial direction, so that a height of the paddle 136 linearly increases from the upstream side toward the downstream side of the developer conveying direction. It can be appreciated, however, that the paddle 136 is not limited thereto, and the paddle 136 may have any of shapes shown in FIGS. 5 through 11, which are described in greater below. There is a common feature between the shapes.

Referring again to FIG. 4, the height of the paddle 136 in the pitch between the agitation wings 134 increases toward the downstream side of the developer conveying direction in order to prevent the developer conveying performance from being degraded from a current state of the developer when the developer is conveyed by the second agitating and conveying member 130 as described above. For example, at the upstream side of the developer conveying direction where the amount of developer in the pitch between the second agitation wings 134 is large, the height of the paddle 136 is lower than the developer level. Meanwhile, at the downstream side of the developer conveying direction where the amount of developer in the pitch between the second agitation wings 134 is small, the height of the paddle 136 is substantially the same as a height of each of the second agitation wings 134.

Additionally, the height of a paddle may be determined according to a position in the axial direction in the pitch between the agitation wings 134. For example, as shown in FIG. 5, it is assumed that a pitch between the second agitation wings 134 is L and a height of each of the second agitation wings 134 in the radial direction is h. Accordingly, a height of a paddle 236, a shown in FIG. 5, is equal to or less than ½ (reference height) of the height "h" of each of the second agitation wings 134 in an area from the upstream side of the developer conveying direction to a position that is ½L in the axial direction of the second support shaft 132. Since the paddle 236 is formed to satisfy these conditions, the second agitating and conveying member 130 may have both a developer agitating function and a developer conveying function.

Configurations of paddles satisfying these conditions will be explained with reference to FIGS. 5 through 11.

Referring again to FIG. 5, the paddle 236 may be disposed in the second agitating and conveying member 130. The paddle 236 may have a height of that increases in a stepped shape toward the downstream side of the developer conveying direction. The paddle 236 of FIG. 5 has a height that is equal to or less than ½ of the height "h" of each of the second agitation wings 134 at the upstream side of the developer conveying direction (the area from the upstream side of the developer conveying direction to the position that is ½L in the axial direction of the second support shaft 132) in the pitch between the second agitation wings 134 as described above. The height of the paddle 236 is substantially the same as the height "h" of each of the second agitation wings 134 at the downstream side of the developer conveying direction.

Although the number of steps of the paddle 236 is 1 in FIG. 5, the paddle 236 may have a plurality of steps. For example, referring to FIG. 6, a paddle 336 includes four portions 336*a*, 336*b*, 336*c*, and 336*d*. Each of the portions 336*a*, 336*b*, 336*c*, and 336*d* has a height that increase from the upstream side to the downstream side of the developer conveying direction. That is, the paddle 336 has a step-like shape including four steps. A height of each of the portions 336*a* and 336*b* located at the upstream side of the developer conveying direction of the paddle 336 is equal to or less than ½ of the height "h" of each of the second agitation wings 134. A height of each of the portions 336*c* and 336*d* located at the downstream side of the developer conveying direction of the paddle 336 is greater than ½ of the height "h" of each of the second agitation wings 134.

The paddles described above may be formed to protrude in the radial direction from the pitch of the second support shaft 132 in all positions in the axial direction (for example, like the paddle 236 of FIG. 5). Alternatively, the paddles described above may be formed to protrude in at least some positions in the radial direction (for example, like the paddle 336 of FIG. 6).

In an alternative embodiment illustrated in FIG. 7, at least one of the first the second agitating and conveying members 121, 130 may include a paddle 436, having one or a plurality of plate-shaped members protruding in the radial direction of the second support shaft 132 and intermittently disposed in the axial direction of the second support shaft 132. For example, the paddle 436 of FIG. 7 may include three substantially rectangular plate-shaped members 436*a*, 436*b*, and 436*c*, with a space between the plate-shaped members 436*a* and 436*b* and between the plate-shaped members 436*b* and 436*c*. Accordingly, a contact area between surfaces of the plate-shaped members 436*a*, 436*b*, and 436*c* and a developer agitating and conveying space is increased, thereby causing a lot of turbulence in the flow of the developer. Accordingly, the developer agitating performance may be further improved.

Still referring to FIG. 7, plate-shaped members 436*a* and 436*b* located at the upstream side of the developer conveying direction of the paddle 436 may have a height that is, for example, equal to or less than ½ of the height "h" of each of the second agitation wings 134. The plate-shaped member 436*c* located at the downstream side of the developer conveying direction of the paddle 336 may have a height that is, for example, greater than ½ of the height "h" of each of the second agitation wings 134.

Referring now to FIG. 8, a paddle 536 may be similar to the paddle of 436 of FIG. 7. The paddle 536 of FIG. 8 includes three plate-shaped members 536*a*, 536*b*, and 536*c* protruding in the radial direction of the second support shaft 132 and intermittently disposed in the axial direction of the second support shaft 132. More specifically, whereas the paddle 436 of FIG. 7 includes the plate-shaped members 436*a*, 436*b*, and 436*c*, heights of which sequentially increase from the upstream side to the downstream side of the developer conveying direction, the paddle 536 of FIG. 8 includes the plate-shaped member 536*b* located at the downstream side and having a height that is lower than a height of the plate-shaped member 536*a* located at the upstream side of the developer conveying direction. However, a height of each of the plate-shaped members 536*a* and 536*b* located at the upstream side of the developer conveying direction of the paddle 536 is equal to or less than ½ of the height "h" of each of the second agitation wings 134.

Accordingly, the developer agitating performance and the developer conveying performance may be improved even when a height of a member of a paddle located at the downstream side of the developer conveying direction is not greater than a height of a member of the paddle located at the upstream side of the developer conveying direction.

Referring now to FIGS. 9 and 10, a through-hole may be formed in a paddle to promote flow of developer through the developing unit 100. Paddles 636 shown in FIGS. 9 and 10 may have a similar same shape as that of the paddle 236 of FIG. 5, but may have a circular through-hole 683*a* and a rectangular through-hole 683*b*, respectively, formed in a rotation direction of the second support shaft 132 at the downstream side of the developer conveying direction. Accordingly, more turbulence may be applied to the developer. As a result, flow of the developer may be increased and the developer agitating performance may be improved. Although the through-holes 683*a* and 683*b* of the paddles 636 respectively are circular and rectangular in FIGS. 9 and 10, the present embodiments are not limited thereto and the through-holes 683*a* and 683*b* may be oval or polygonal such as triangular or pentagonal.

Referring now to FIG. 11, at least one of the first and second agitating and conveying members 121, 130 may include a paddle 736 having a height of that continuously increases in a curved shape toward the downstream side of the developer conveying direction. A height of the paddle 736 of FIG. 11 at the upstream side of the developer conveying direction (i.e., the area from the upstream side of the developer conveying direction to the position that is ½L in the axial direction of the second support shaft 132) in the pitch between the second agitation wings 134 may be equal to or less than ½ of the height "h" of each of the second agitation wings 134. Additionally, a height of the paddle 736 at the downstream side of the developer conveying direction may be substantially the same as the height "h" of each of the second agitation wings 134.

Exemplary configurations of the paddles 136, 236, 336, 436, 536, 636, and 736 have been described with reference to FIGS. 4 through 11. Although the shapes of the paddles 136, 236, 336, 436, 536, 636, and 736 may vary as described above, a height of each paddle is low at the upstream side of the developer conveying direction where large amounts of developer accumulate in the pitch between the agitation wings 134 is large in order not to reduce the developer agitating performance. On the other hand, a height of each paddle is large at the downstream side of the developer conveying direction where small amounts of developer accumulate in order to increase the developer agitating force. Accordingly, the second agitating and conveying member 130 may provide both a developer agitating function and a developer conveying function without damaging the developer supplied to the developing roller 110.

Also, as shown in FIG. 3, for example, transfer-and-receive units 103 and 104 to transfer and receive the developer between the first agitating and conveying member 121 and the second agitating and conveying member 130 are formed on both ends of the first agitating and conveying member 121 and the second agitating and conveying member 130. The partition wall 102 is installed between the first agitating and conveying member 121 and the second agitating and conveying member 130 inside the transfer-and-receive units 103 and 104. The paddle may be formed extending along a distance W of the partition wall 102 and in the axial direction (X-axis direction). Accordingly, the paddle is positioned to face the partition wall 102, and may agitate the developer while preventing the developer from leaking out in a centrifugal direction.

Additionally, one or more paddles may be formed on one agitating and conveying member. If one or more paddles are included with at least one of the agitating and conveying members 121, 130, the paddles may be installed with a predetermined pitch number, for example, a pitch=1. Accordingly, the agitating and conveying unit may be designed by considering balance between the developer agitating force and the developer conveying performance.

Also, a plurality of paddles may be installed on one agitating and conveying member, and paddles may be aligned with one another such that each paddle moves in the same direction when rotating along with the support shaft of the agitating and conveying member. If the paddles are disposed to have different phases, turbulence occurs several times while the support shaft of the agitating and conveying member rotates one time, thereby degrading the developer agitating performance.

Therefore, at least one exemplary embodiment of the present general inventive concept provides an agitating and conveying member including paddles disposed along a support shaft to have the same phase with one another. Accordingly, turbulence within a developer unit may be inhibited and an amount of excess developer that may accumulate in the developing unit is reduced.

While the present general inventive concept has been particularly shown and described with reference to exemplary embodiments thereof using specific terms, the embodiments and terms have been used to explain the present general inventive concept and should not be construed as limiting the scope of the present general inventive concept defined by the claims. Accordingly, it will be understood by those of ordinary skill in the art that various changes in form and details may be made therein without departing from the spirit and scope of the present general inventive concept as defined by the following claims.

For example, although a reference height of each paddle in the embodiments may be ½ of a height of each agitation wing, the present general inventive concept is not limited thereto. The reference height of the paddle may be determined according to a developer distribution state in an agitating and conveying unit, and may be ⅓ of the height of the agitation wing. Also, although an area where the height of the paddle may be equal to or less than the reference height is an upstream side of a developer conveying direction when a pitch between adjacent agitation wings is divided into two sections in the exemplary embodiments, the present general inventive concept is not limited thereto. For example, the corresponding area may also be appropriately determined according to a developer distribution state in the agitating and conveying unit.

Although a few embodiments of the present invention have been shown and described, it would be appreciated by those skilled in the art that changes may be made in these embodiments without departing from the principles and spirit of the general inventive concept, the scope of which is defined in the claims and their equivalents.

What is claimed is:

1. A developing device comprising:

an agitating and conveying unit that receives a developer formed of carrier and toner, and includes at least one agitating and conveying member to mix and agitate the developer and convey the developer in a developer conveying direction; and a developing roller that is installed facing a photosensitive drum to receive an electrostatic latent image is formed thereon, and that attaches the developer mixed and agitated by the agitating and conveying unit to an outer circumferential surface of the developing roller and that supplies the developer to the photosensitive drum, wherein the agitating and conveying member comprises:

a support shaft that extends in the developer conveying direction and is rotatably coupled to the developing device to convey toner from an upstream end to a downstream end thereof;

a plurality of agitation wings that are disposed on an outer circumferential surface of the support shaft to define a pitch between adjacent agitation wings and to mix and agitate the developer and to convey the developer along the developer conveying direction; and at least one paddle which protrudes in a radial direction from the support shaft and extends along a direction of the support shaft in the pitch and has an upstream-most end having a first height and a downstream-most end having a second height such that the second height increases from the first height in a non-linear manner.

2. The developing device of claim 1, wherein the height of the paddle gradually increases from the upstream side to the downstream side of the developer conveying direction.

3. The developing device of claim 1, wherein the height of the paddle continuously increases from the upstream side to the downstream side of the developer conveying direction.

4. The developing device of claim 1, wherein the height of the paddle is equal to or less than ½of a height of each of the agitation wings at the upstream side of the developer conveying direction.

5. The developing device of claim 1, wherein a portion of the paddle located at the downstream side of the developer conveying direction has a through-hole formed in a direction perpendicular to a length of the support shaft.

6. The developing device of claim 1, wherein a plurality of paddles disposed in the pitch between the agitation wings on the same support shaft are aligned in the direction of the support shaft.

7. The developing device of claim 1, wherein a plurality of the agitating and conveying members are disposed parallel to one another, transfer-and-receive units are installed on both ends of the plurality of agitating and conveying members so that the plurality of agitating and conveying members are connected to one another, and the paddle is installed inside the transfer-and-receive units.

8. An image forming apparatus comprising:

a photosensitive drum including an outer circumferential surface of which an electrostatic latent image is formed; and a developing device that develops the electrostatic latent image formed on the photosensitive drum, wherein the developing device comprises:

an agitating and conveying unit that receives a developer formed of carrier and toner, and includes at least one agitating and conveying member to mix and agitate the developer and convey the developer in a developer conveying direction; and a developing roller that is installed facing a photosensitive drum to receive an electrostatic latent image is formed thereon, and that attaches the developer mixed and agitated by the agitating and conveying unit to an outer circumferential surface of the developing roller and that supplies the developer to the photosensitive drum, wherein the agitating and conveying member comprises:

a support shaft that extends in the developer conveying direction and is rotatably coupled to the developing device;

a plurality of agitation wings that are disposed on an outer circumferential surface of the support shaft to define a pitch between adjacent agitation wings and to mix and agitate the developer and to convey the developer along the developer conveying direction; and at least one paddle which protrudes in a radial direction from the support shaft and extends along a direction of the support shaft in the pitch and has an upstream-most end having a first height and a downstream-most end having a second height such that the second height increases from the first height in a non-linear manner.

9. The image forming apparatus of claim 8, wherein the height of the paddle gradually increases from the upstream side to the downstream side of the developer conveying direction.

10. The image forming apparatus of claim 8, wherein the height of the paddle continuously increases from the upstream side to the downstream side of the developer conveying direction.

11. The image forming apparatus of claim 8, wherein the height of the paddle is equal to or less than ½of a height of each of the agitation wings at the upstream side of the developer conveying direction.

12. The image forming apparatus of claim 8, wherein a portion of the paddle located at the downstream side of the developer conveying direction has a through-hole formed in a direction perpendicular to a length of the support shaft.

13. The image forming apparatus of claim 8, wherein a plurality of the paddles disposed in the pitch between the agitation wings on the same support shaft are aligned in the direction of the support shaft.

14. The image forming apparatus of claim 8, wherein a plurality of the agitating and conveying members are disposed parallel to one another, transfer-and-receive units are installed on both ends of the plurality of agitating and conveying members so that the plurality of agitating and conveying members are connected to each other, and the paddle is installed inside the transfer-and-receive units.

15. An agitating and conveying unit to convey developer stored in a developing unit in a conveying direction, comprising:

a first support shaft extending along the conveying direction;

a second support shaft disposed adjacent the first support shaft and extending parallel to the first support shaft in the conveying direction;

a partition disposed between the first and second support shafts to define first and second developer passages between the developing unit and the partition;

a plurality of first wings disposed on the first shaft each being inclined in a first direction and having a first pitch to define a space between adjacent agitation wings; and a plurality of second wings disposed on the second shaft each being inclined in a second direction opposite the first direction of the first wings and having a second pitch to define a space between adjacent agitation wings, at least one paddle that protrudes in a radial direction from at least one of the first and second support shafts and extends along a direction of the at least one of the first and second support shafts in at least one of the first and second pitch and has an upstream-most end having a first height and a downstream-most end having a second height such that the second height increases from the first height in a non-linear manner.

16. The agitating and conveying unit of claim 15, wherein the first support shaft further comprises a first opposing wing being inclined in the second direction opposite the first direction of the plurality of first wings and extending into the first developer passage.

17. The agitating and conveying unit of claim 16, wherein the second support shaft further comprises a second opposing wing being inclined in the first direction opposite the second direction of the plurality of second wings and extending into the second developer passage.

18. The agitating and conveying unit of claim 15 wherein the first developer passage is located adjacent a downstream end of the first and second supports shafts and wherein the second developer passage is located an upstream end of the first and second support shafts.

* * * * *